US008839908B2

(12) United States Patent
Davis, Jr.

(10) Patent No.: US 8,839,908 B2
(45) Date of Patent: Sep. 23, 2014

(54) LADDER SAFETY APPARATUS

(71) Applicant: Don M. Davis, Jr., Colorado Springs, CO (US)

(72) Inventor: Don M. Davis, Jr., Colorado Springs, CO (US)

( * ) Notice: Subject to any disclaimer, the term of this patent is extended or adjusted under 35 U.S.C. 154(b) by 0 days.

(21) Appl. No.: 13/791,653

(22) Filed: Mar. 8, 2013

(65) Prior Publication Data

US 2013/0199874 A1 Aug. 8, 2013

Related U.S. Application Data

(63) Continuation-in-part of application No. 13/362,230, filed on Jan. 31, 2012, which is a continuation-in-part of application No. 13/223,261, filed on Aug. 31, 2011, now Pat. No. 8,602,163.

(60) Provisional application No. 61/426,876, filed on Dec. 23, 2010.

(51) Int. Cl.
*E06C 7/18* (2006.01)
*E06C 7/48* (2006.01)

(52) U.S. Cl.
CPC . *E06C 7/188* (2013.01); *E06C 7/48* (2013.01); *E06C 7/182* (2013.01)
USPC ..... 182/107; 182/106

(58) Field of Classification Search
USPC ..... 182/106, 107, 214
See application file for complete search history.

(56) References Cited

U.S. PATENT DOCUMENTS

| | | | | | |
|---|---|---|---|---|---|
| 1,018,877 | A | | 2/1912 | Chickering | |
| 2,881,028 | A | | 4/1959 | Baird | |
| 4,061,203 | A | * | 12/1977 | Spencer et al. | 182/214 |
| 4,359,138 | A | | 11/1982 | Kummerlin et al. | |
| 4,502,566 | A | | 3/1985 | Wing | |
| 4,653,608 | A | * | 3/1987 | Casada | 182/121 |
| 4,765,439 | A | | 8/1988 | Kresmery | |
| 4,949,810 | A | * | 8/1990 | Dwinnell | 182/214 |
| 5,121,814 | A | | 6/1992 | Southern | |
| 5,131,494 | A | | 7/1992 | Heifetz | |
| 5,242,031 | A | * | 9/1993 | Ashley | 182/214 |
| 5,261,507 | A | | 11/1993 | Williams et al. | |
| 5,279,389 | A | * | 1/1994 | Crockett | 182/129 |
| 5,941,343 | A | | 8/1999 | Kelsey | |
| 6,012,546 | A | | 1/2000 | Bee et al. | |
| 6,394,229 | B1 | | 5/2002 | Hastreiter | |
| 6,533,069 | B1 | | 3/2003 | Couillard | |
| 6,745,869 | B2 | | 6/2004 | Garrett | |
| 6,851,518 | B1 | | 2/2005 | Walker | |
| 7,066,299 | B1 | | 6/2006 | Fleming | |
| 7,322,442 | B2 | | 1/2008 | Clark et al. | |
| 7,934,584 | B2 | * | 5/2011 | Groy | 182/129 |

(Continued)

*Primary Examiner* — Alvin Chin-Shue
(74) *Attorney, Agent, or Firm* — Mark D. Trenner; Trenner Law Firm, LLC

(57) ABSTRACT

A ladder safety apparatus and methods of using the same are disclosed. An example ladder safety apparatus includes a stabilizer bar for a top portion of a ladder, the stabilizer bar configured to rest on a roof top. The example ladder safety apparatus also includes a balance rail for the top portion of the ladder to provide substantially upright handles for a user to grasp when the ladder is positioned on the roof top. Further, the safety apparatus may be engaged to a ladder using one or more engagement rods.

7 Claims, 18 Drawing Sheets

(56) References Cited

U.S. PATENT DOCUMENTS

| | | | | |
|---|---|---|---|---|
| 8,235,175 | B1 | 8/2012 | Feldhaus | |
| 2002/0134619 | A1 | 9/2002 | Schwenke | |
| 2005/0023084 | A1 | 2/2005 | Lazarus | |
| 2005/0211501 | A1 | 9/2005 | Maiorano | |
| 2008/0190692 | A1 | 8/2008 | Feik | |
| 2009/0000868 | A1* | 1/2009 | Gaines | 182/106 |
| 2010/0230208 | A1 | 9/2010 | Hsiao et al. | |
| 2011/0247895 | A1* | 10/2011 | Smith | 182/106 |

* cited by examiner

LADDER SAFETY APPARATUS

PRIORITY CLAIM

This application claims the priority benefit as a continuation-in-part (CIP) patent application of U.S. patent application Ser. No. 13/362,230 titled "Ladder Safety Apparatus," which is a continuation-in-part (CIP) of U.S. patent application Ser. No. 13/223,261 titled "Ladder Safety Apparatus" of Don Morris Davis, Jr., filed on Aug. 31, 2011, which claims priority to U.S. Provisional Patent Application No. 61/426,876 titled "Ladder Rooftop Safety Apparatus" of Don Morris Davis Jr., filed on Dec. 23, 2010, each incorporated herein by reference as though fully set forth herein.

BACKGROUND

Individuals often use ladders to access high or steep roof areas. Ascending and descending the ladder can be dangerous, particularly with conventional ladders which may be unstable and limited by the amount of weight these ladders can handle.

For example, if the top portion of the ladder is not extended high enough past the edge of the roof, the ladder may become disengaged from the side edge of the roof (or fascia). In addition, leaning the ladder on the fascia or gutters may cause scratching of the fascia and/or gutters as the user climbs the ladder.

Extending the top portion of the ladder past the edge of the roof can pose an additional safety concern, because the user has to dismount the ladder onto the roof top by climbing up and over the top portion of the ladder, or going around on the side of the top portion of the ladder.

In addition, if the user does not have a helper to hold and steady the ladder while the user is climbing, the ladder can slide sideways and endanger the safety of the user climbing on the ladder. Traditional ladders may also pivot at the point of contact with the ground and/or "kick" the bottom of the ladder out, causing the ladder to be unstable.

DETAILED DESCRIPTION

Many individuals do jobs where the individual has to access a high or steep roof top, and then descend after the job is complete. Conventional ladders tend to be unsafe and unstable, and are also limited by the weight these ladders can handle. The top portion of the ladder that extends past the edge of the roof top can be a particular safety concern. If the ladder begins to sway, it is possible that the individual could fall and be seriously injured or worse. It is not always possible to have another individual steady the ladder while the user climbs on the ladder. Even if someone tried to steady the ladder, the ladder can still slide due to leveraging effects.

The ladder safety apparatus disclosed herein provides users with an easier and safer method for accessing a roof top. The apparatus may be used by homeowners and professionals who use ladders to climb onto steep or high roofs. For example, roofers, inspectors, insurance adjusters, and contractors all use extension ladders on a regular basis.

The ladder safety apparatus disclosed herein helps the user climb safely up the ladder onto the roof top, and then descend. The ladder safety apparatus affords stability, reducing the ladder from moving, and provides hand rails for the user.

Before continuing, it is noted that as used herein, the terms "includes" and "including" mean, but are not limited to, "includes" or "including" and "includes at least" or "including at least." The term "based on" means "based on" and "based at least in part on."

Figure 1:
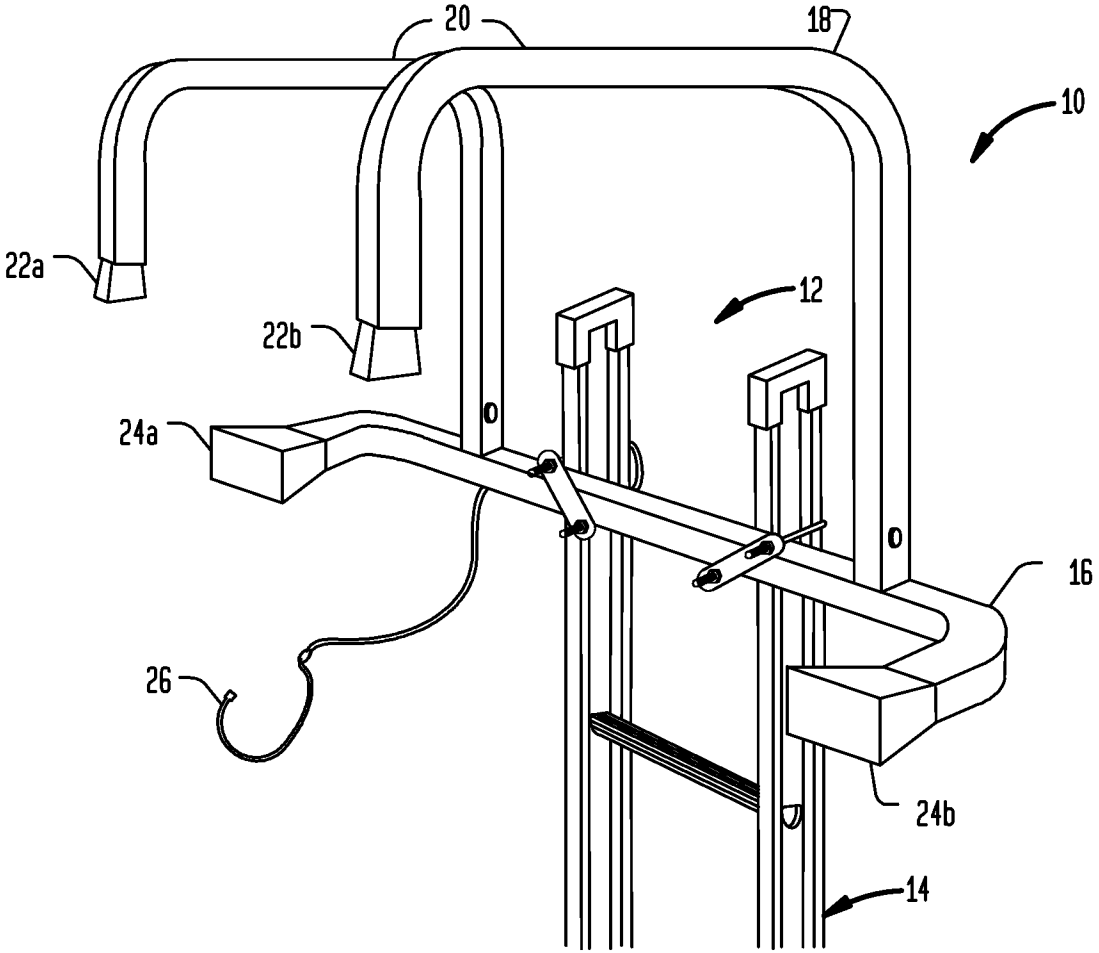
FIG. 1 is a perspective view of an example ladder safety apparatus as it may be attached to a top portion of a ladder.

FIG. 1 is a perspective view of an example ladder safety apparatus 10 as it may be attached to a top portion 12 of a ladder 14. The ladder safety apparatus 10 may be made of aluminum or fiberglass or other material which is sufficiently lightweight to be used in the ladder environment, but sufficiently strong to provide the desired support.

The ladder safety apparatus 10 may include a stabilizer bar 16 for the top portion 12 of the ladder 14. The stabilizer bar 16 is configured to rest on a roof top (see, e.g., FIG. 2). In an example, the stabilizer bar 16 may be about 16 inches or less (at least the width of the ladder) to 48 inches wide (or more, based on application). However, the exact specifications may vary based on design considerations.

A balance rail 18 extends up above the top portion 12 of the ladder 14 and provides handles 20 for a user climbing onto the roof top. An opening is formed between the handles 20 so that the user can climb between the handles and onto the rooftop, without having to climb up and over or around the top portion 12 of the ladder 14.

The stabilizer bar 16 can be removably mounted to the ladder 14. In an example, U-clamps may be used to fasten the stabilizer bar to the ladder 14. Other examples are also contemplated, including semi-permanent and more permanent attachments. The stabilizer bar may extend substantially perpendicular from the ladder, although this is not required in other embodiments where different angles are desired. The balance rail 18 can be formed as part of, or mounted to the stabilizer bar 16.

It is noted that the stabilizer bar 16 and the balance rail 18 may be attachable/detachable to the ladder. In another example, the stabilizer bar 16 and the balance rail 18 may be permanently attached to the ladder.

The stabilizer bar 16 may include footings 22*a* and 22*b*. The balance rail 18 may also include footings 24*a* and 24*b*. The footings may be configured to substantially conform to a portion of the roof top. For example, the footings may be made of a pliable material, such as rubber. Soft materials can also reduce or altogether prevent damage to the roof top. The footings may also provide better traction on wet or slippery roof tops.

The ladder safety apparatus 10 may also include an attached strap 26 to connect adjacent the roof top for securing the ladder. The attached strap 26 may be permanently connected to the ladder safety apparatus 10 so that the attached strap 26 does not get lost, or left behind on the ground when the user climbs up the ladder 14. In an example, the attached strap 26 may be a flexible cord and may include a hook for connecting to the fascia and/or gutter.

Figure 2:
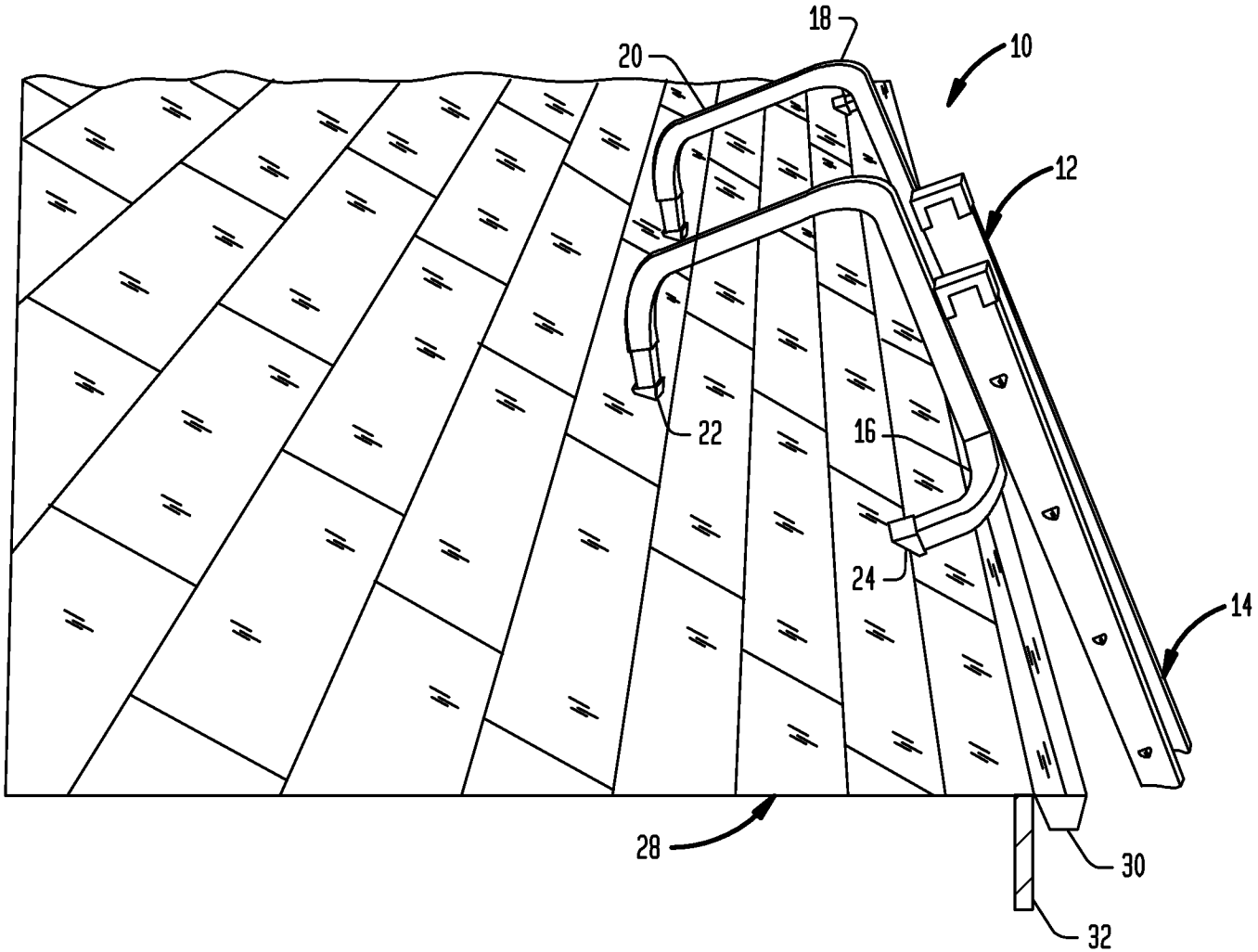
FIG. 2 is an illustration showing the example ladder safety apparatus as it may be used on a roof top.

FIG. 2 is an illustration showing the example ladder safety apparatus 10 as it may be used on a roof top 28. It can be seen in FIG. 2 that the stabilizer bar 16 and the balance rail 18 are configured to maintain the ladder separated and apart from the roof top 28, gutters 30, and fascia 32 without touching the gutters 30 and the fascia 32. For example, the stabilizer bar 16 and the balance rail 18 each have two legs that contact the roof top 28, thus maintaining the edge of the ladder 14 away from the edge of the roof top 28.

Figure 3:
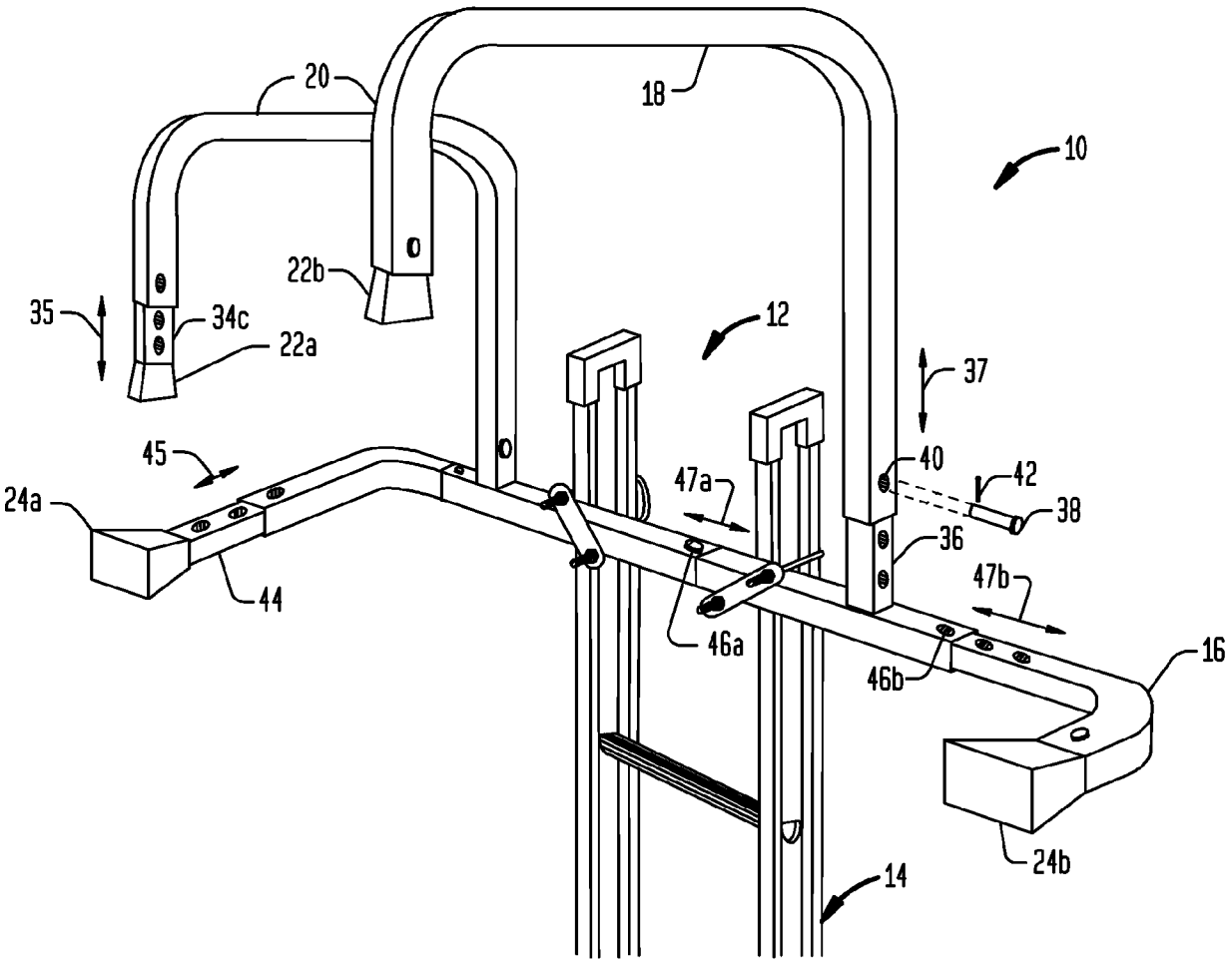
FIG. 3 is a perspective view of the example adjustable ladder safety apparatus as it may be adjusted.

FIG. 3 is a perspective view of the example ladder safety apparatus 10 as it may be adjusted. FIG. 3 shows various adjustments which can be made. For example, the ladder safety apparatus 10 may include extensions 34 for the balance rails 18. The extensions 34 may be telescoped in and out of balance rails 18 in the direction illustrated by arrow 35 to adjust the handrail for contact with different slope roof tops and also accommodate the angle of the ladder 14 relative to the ground.

The ladder safety apparatus 10 may also include extensions 36 for the balance rail 18. The extensions 36 may be telescoped in and out of the balance rails 18 in the direction illustrated by arrow 37 to adjust a height of the balance rail 18 above the top portion 12 of the ladder 14. It is noted that both handrails may include telescoping extensions 34 and 36, although only one of each of the extensions 34 and 36 is shown telescoping in FIG. 3.

Before continuing, it is noted that the telescoping extensions described herein may include pin holes and pins. For example, the pin 38 may be removed from pin hole 40 so that the balance rail 18 can be raised and lowered. When the balance rail 18 is located at the desired height, the pin 38 can be reinserted through the pin hole 40. A cotter pin 42 may be used to secure the pin 38. Other embodiments are also contemplated. For example, the pin 38 may be threaded and a nut may be attached to the pin 38. Or the pin hole 40 may be threaded. Spring-based pins (e.g., provided inside the extensions) may also be used, wherein the spring-based pins are pushed in to allow the balance rail 18 to move up and down, and then the spring-based pins automatically expand into the pin hole 40 for securement. Yet other embodiments may also be employed.

The stabilizer bar 16 may include extensions 44 to adjust distance between the ladder 14 and the roof top. The extensions 44 may be telescoped in and out of the stabilizer bars 16 in the direction illustrated by arrow 45 to adjust the distance.

The stabilizer bar 16 may also be configured with an adjustable width. In an example, pin 46*a* may be removed from the corresponding pin hole so that the stabilizer bar 16 can be pulled apart and pushed together in the direction illustrated by arrow 47*a*. In another example, pin may be removed from the corresponding pin hole 46*b* so that the end of the stabilizer bar 16 can be pulled apart and pushed together in the direction illustrated by arrow 47*b*.

It is noted that both end portions of the stabilizer bar 16 may include telescoping extensions, although only one of each of the extensions is shown telescoping in FIG. 3.

Figure 4:
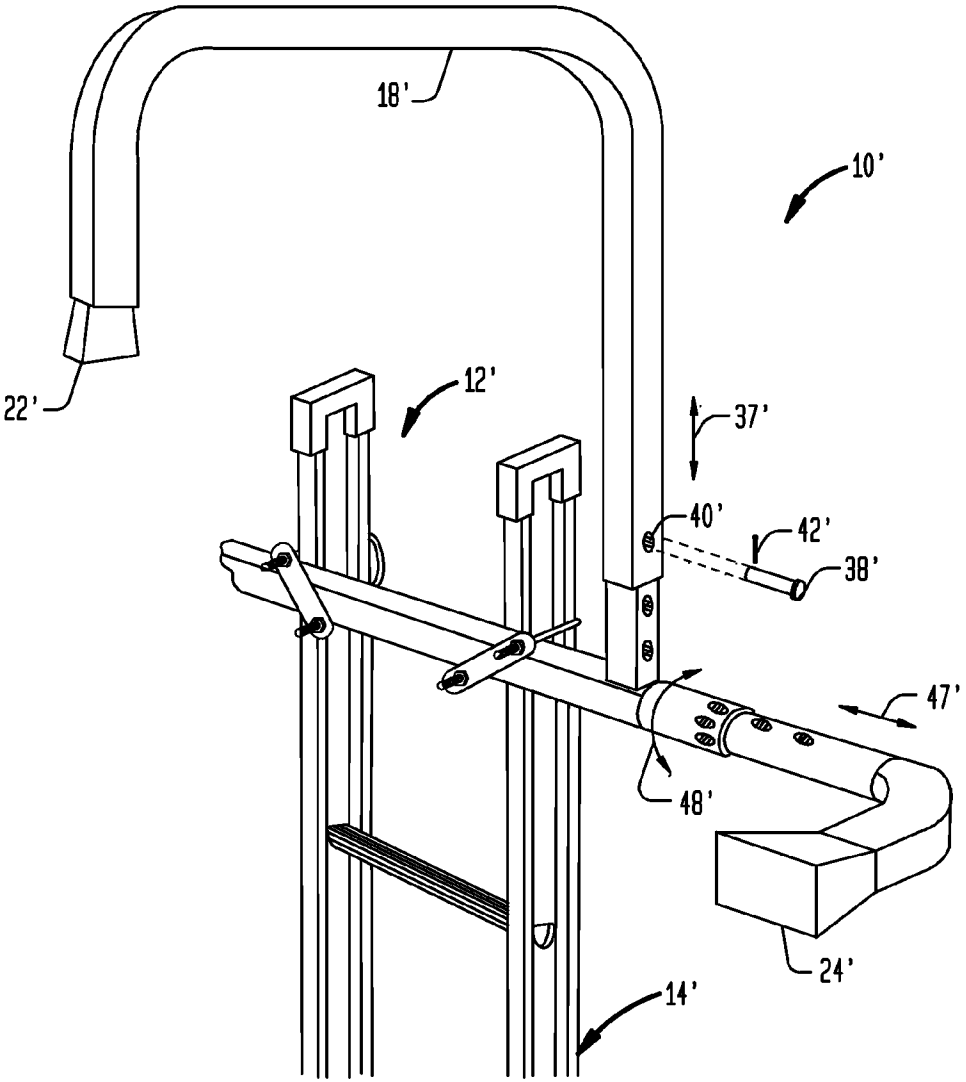
FIG. 4 is a perspective view of another example adjustable ladder safety apparatus.

FIG. 4 is a perspective view of another example adjustable ladder safety apparatus 10'. In this example, the stabilizer bar 16' is rotatable relative to the ladder 14' to adjust an angle of the stabilizer bar 16' for different slope roofs. For example, the stabilizer bar 16' may include at least a portion which is tube-shaped so that the footing 24' can be rotated in the directions illustrated by arrow 48'. Multiple pin holes 50 may be provided so that the end of the stabilizer bar 16' can be secured at the desired angle.

Figure 5:
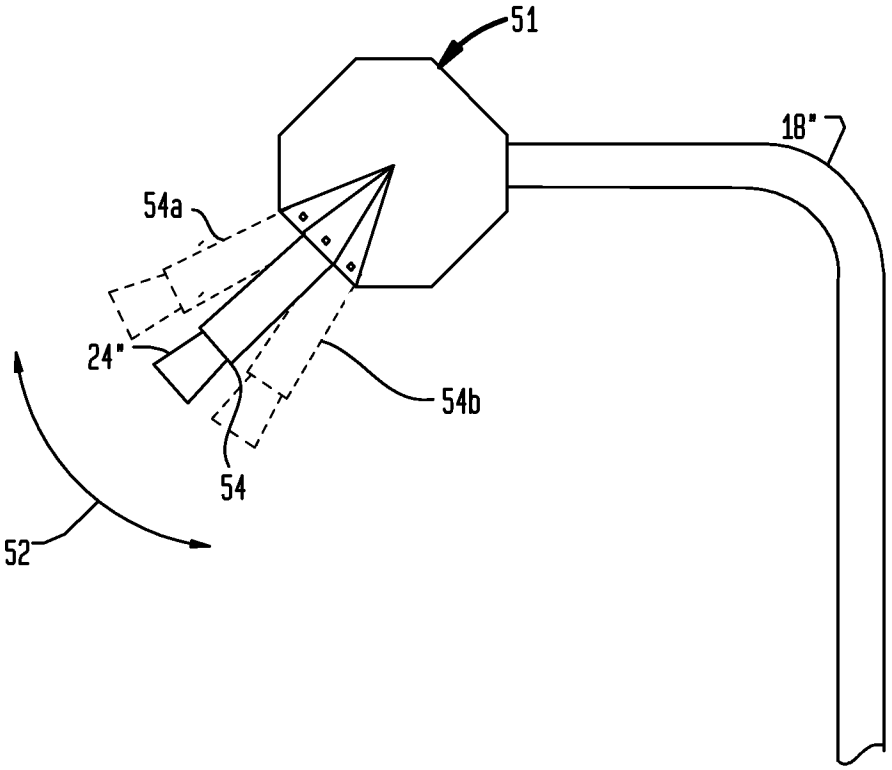
FIG. 5 is a side view of an example rotator cuff which may be used to adjust an angle of rotation of a balance rail for a ladder safety apparatus.

FIG. 5 is a side view of an example rotator cuff 51 which may be used to adjust an angle of rotation (e.g., in the direction of arrow 52) of a balance rail 18" for a ladder safety apparatus. The rotator cuff 51 may be used to adjust an angle of the balance rail 18" for different sloped roofs. The pin and pin hole configuration is also illustrated in FIG. 5, for locking the end portion of the balance rail 18" in different positions. For example, the end portion of the balance rail 18" is shown in a first position 54, and it can also be seen two other positions 54*a* and 54*b* which the end portion can be moved to and locked in place. Other locking mechanisms can also be used to maintain the end portion of the balance rail 18" at the desired position.

It can be seen that the adjustable portions of the ladder safety apparatus 10 and 10' enable a stabilizer bar having at least three degrees of freedom to rest on different types of roof tops. That is, the stabilizer bar can be adjusted in the direction of arrow 45 (FIG. 3), arrows 47*a* and 47*b* (FIG. 3), and rotated in the direction of arrow 48' (FIG. 4).

It can also be seen that the adjustable portions of the ladder safety apparatus 10 and 10' enable a balance rail with at least two degrees of freedom. That is, the balance rail can be adjusted in the direction of arrows 35 and 37 (FIG. 3), and rotated in the direction of arrow 52 (FIG. 5).

FIGS. 6*a-d* show further examples of the ladder safety apparatus. The ladder safety apparatus 110 includes balance rails 118 with handles 120, and stabilizer bar 116. Other components may be similar to those already described above, and therefore the description of these components is not repeated here.

Figure 6A:
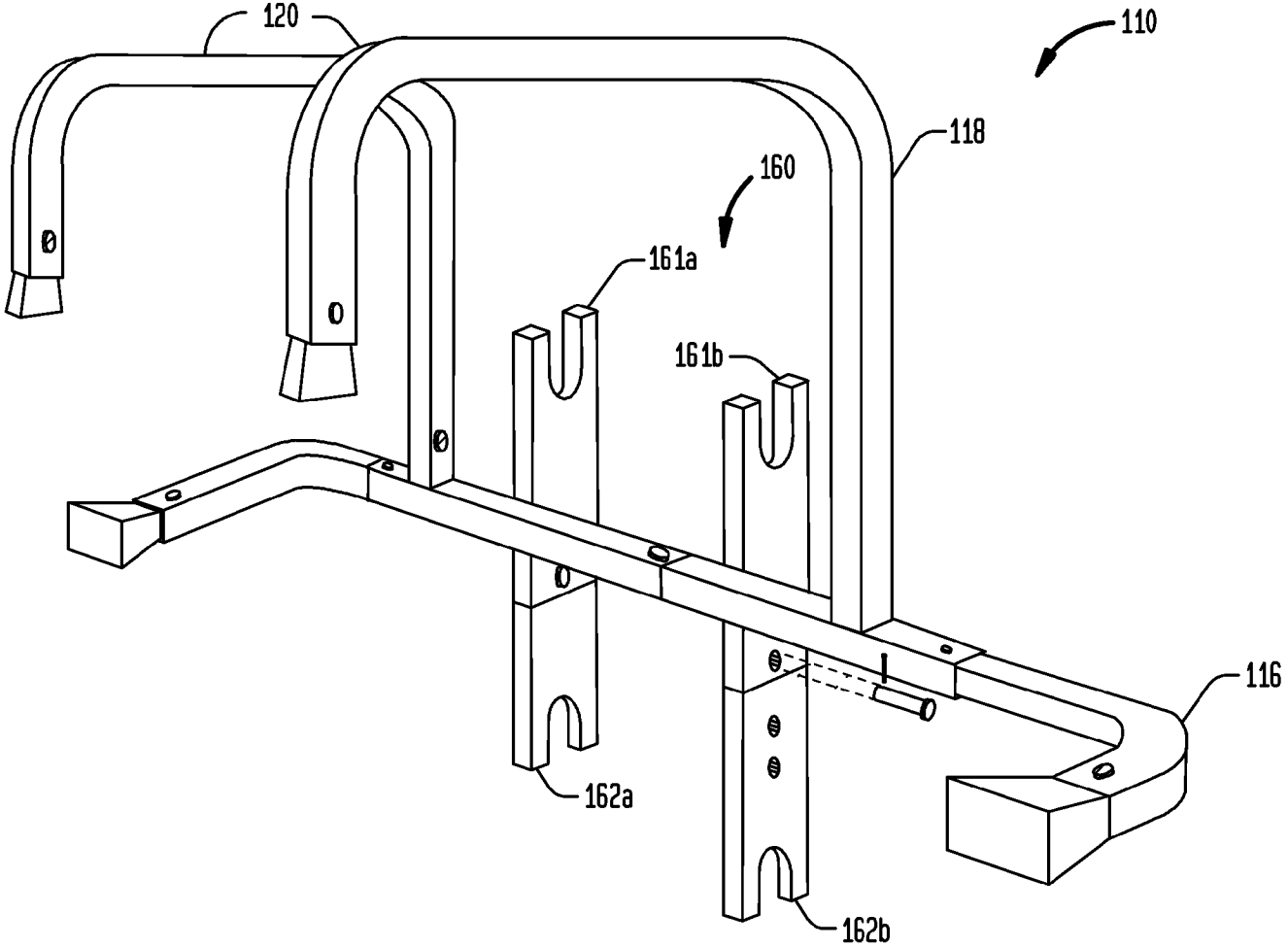
FIG. 6*a-d* show further examples of the ladder safety apparatus.

In the example shown in FIG. 6*a*, the ladder safety apparatus 110 attaches to the ladder with attachment system 160, including telescoping arms 161*a-b* and 162*a-b*. Arms 161*a* and 162*a* are shown in a collapsed position so that the attachment system 160 may fit between adjacent rungs on the ladder. The arms may then be extended, as shown by arms 161*b* and 162*b* to fit securely between the adjacent ladder rungs, thereby securing the ladder safety apparatus to any desired position on the ladder. Once extended, arms 161*b* and 162*b* may be secured in any suitable manner, e.g., using the pin and hole locking mechanism illustrated in FIG. 6*a*, or other suitable locking mechanism.

Figure 6B:
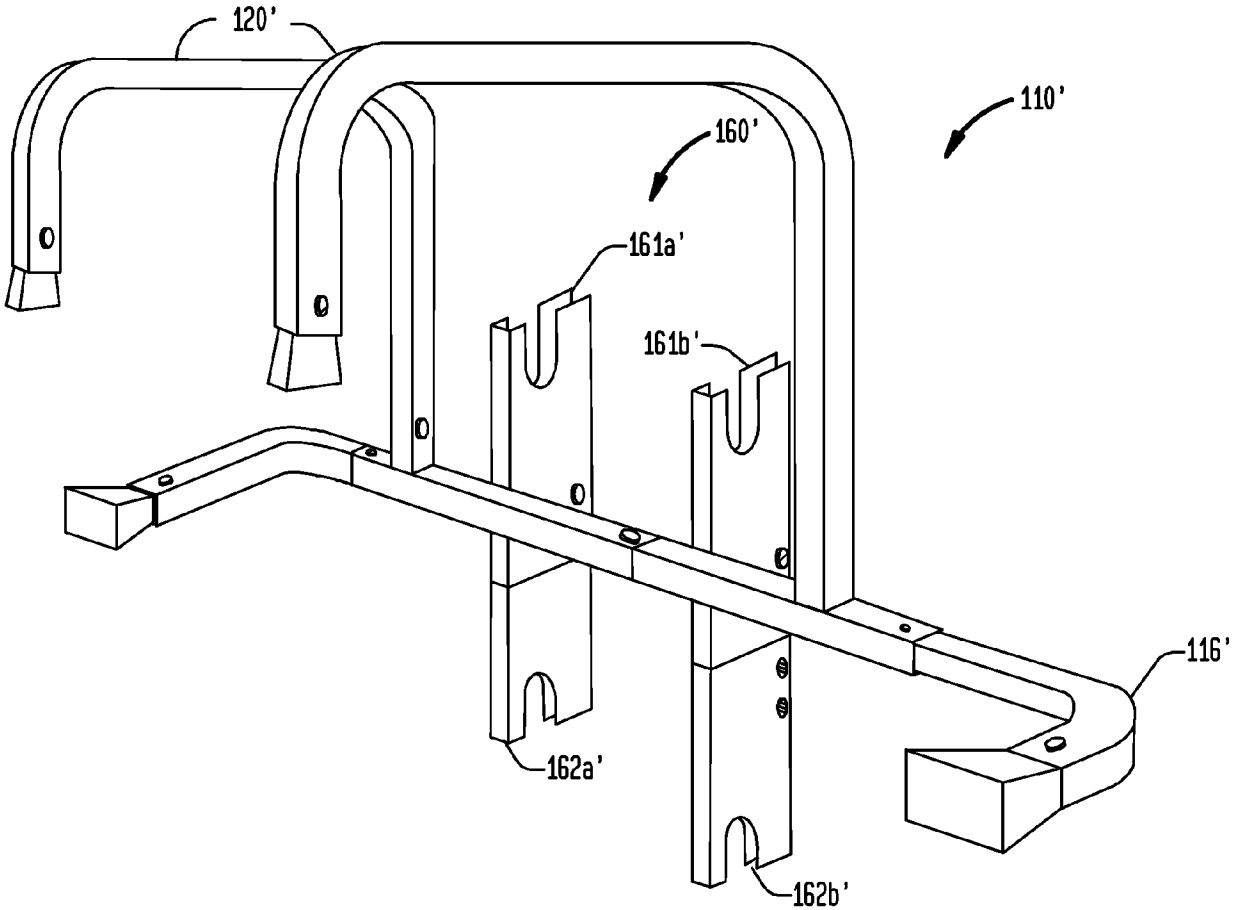

The example shown in FIG. 6*b* is similar to that shown in FIG. 6*a*, except that the arms 161*a-b*' and 162*a-b*' form a channel which can be fitted around the legs of the ladder for additional securement.

Figures 6C, 6D:
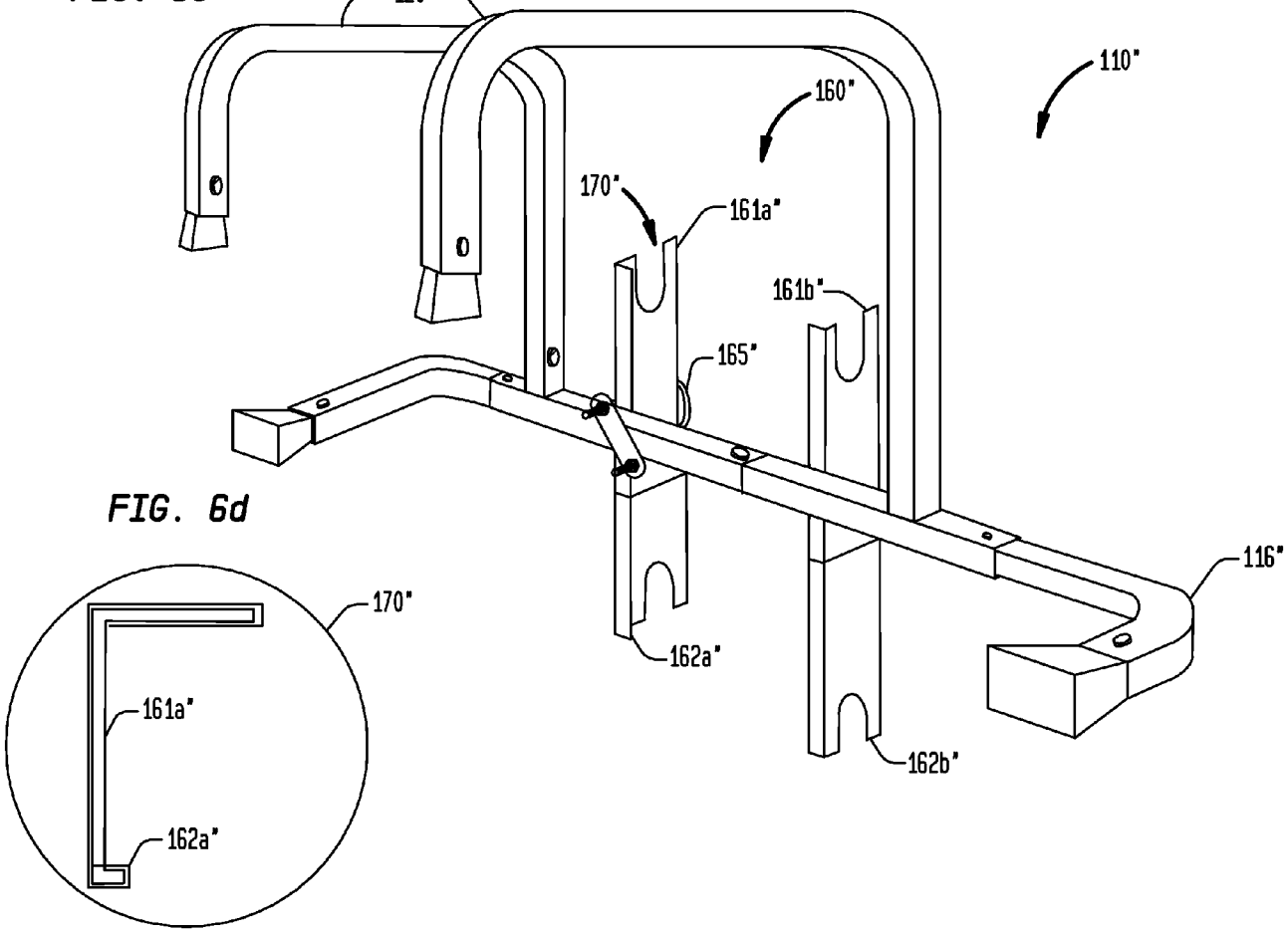

The example shown in FIG. 6*c* is similar to that shown in FIGS. 6*a* and 6*b*, except that the arms 161*a-b*" and 162*a-b*" are substantially L-shaped, and can be fitted on the legs of the ladder. In addition, the attachment system 160" shown in FIG. 6*c* includes U-clamps 165" which can be used to connect the ladder safety apparatus 110" to the ladder (instead of, or in addition to the pin securement shown in FIGS. 6*a* and 6*b*).

FIG. 6*d* shows a cross-sectional plan view taken from 170" and looking down at the top of the attachment system 160". The FIGURE illustrates an telescoping configuration wherein the arm 161*a*" fits inside of the arm 162*a*".

Figure 7:
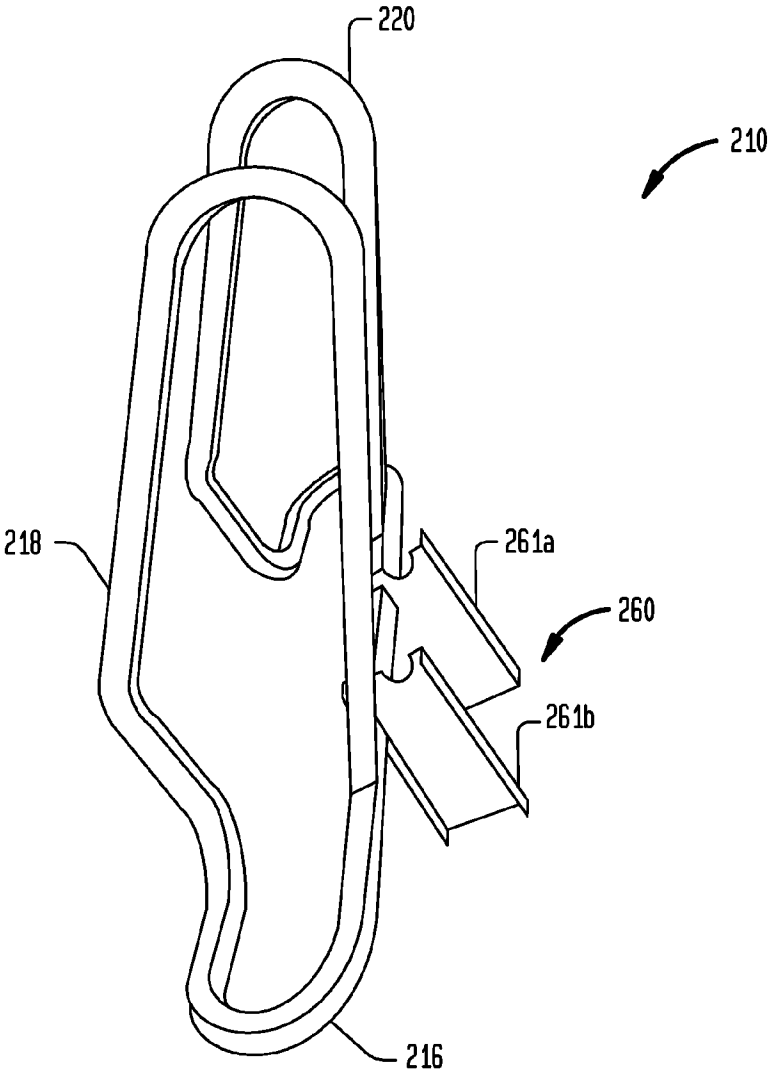
FIG. 7 is a perspective view of another example ladder safety apparatus.

FIG. 7 is a perspective view of another example ladder safety apparatus 210. The ladder safety apparatus 210 includes balance rails 218 with handles 220, and stabilizer bar 216 on each side. In this example, the ladder safety apparatus 210 is shown as it may be formed as a single or uniform structure, e.g., as extruded plastic or shaped aluminum.

Figure 8B:
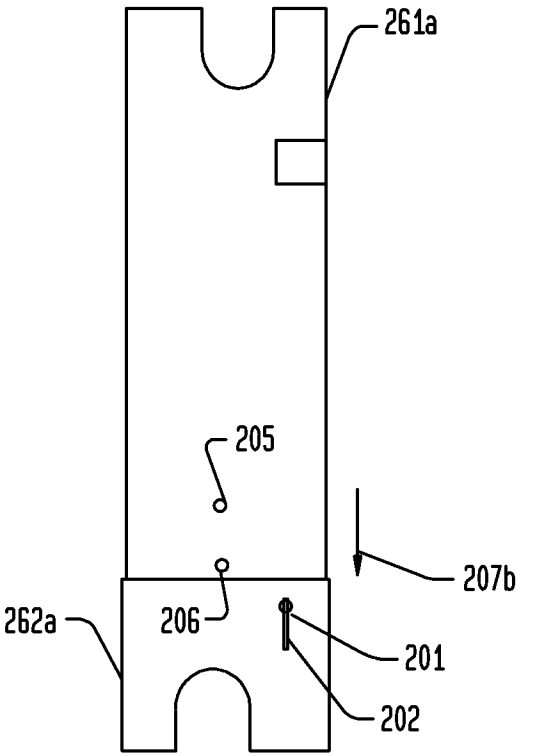
FIG. 8 shows an example attachment system for the ladder safety apparatus of FIG. 7, where (a) and (b) is a side view illustrating operation of first and second adjustable members, (c) is a perspective view of a first adjustable member, and (d) is a perspective view of a second adjustable member.
Figure 8A:
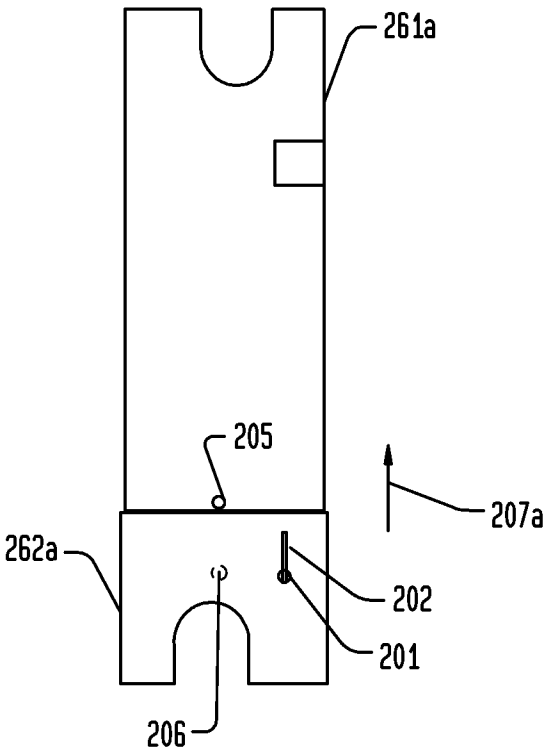
Figure 8D:
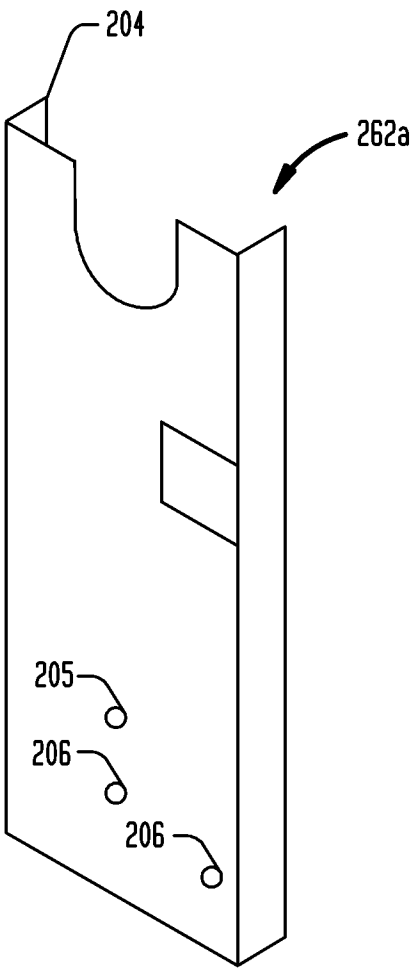
Figure 8C:
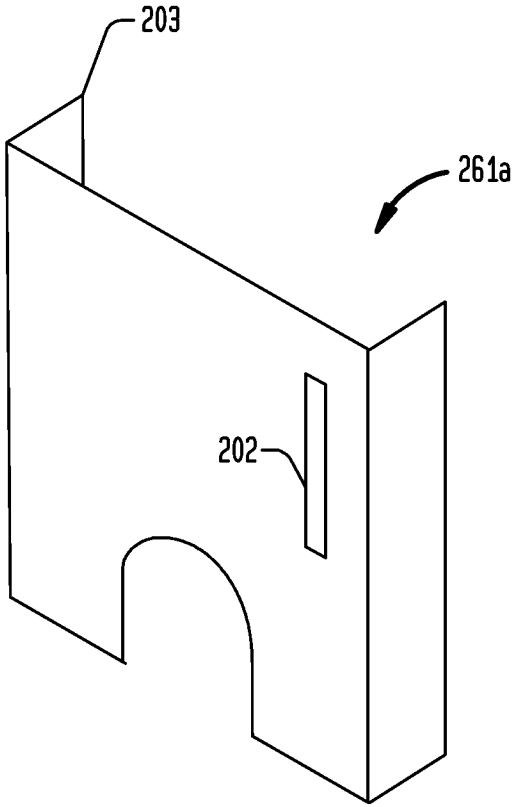

In an example, the ladder safety apparatus 210 may be permanently attached to and/or formed as part of a ladder. However, in the example shown in FIG. 7, the ladder safety apparatus 210 attaches to the ladder with attachment system 260, including telescoping arms 261*a-b*. Arms 261*a* and 262*a* may be used in conjunction with arms 262*a-b*, as shown in FIGS. 8*a-c*. FIG. 8 shows an example attachment system 260 for the ladder safety apparatus 210 of FIG. 7, where (a) and (b) is a side view illustrating operation of first and second adjustable members or arms 261*a-b* and 262*a-b*, (c) is a perspective view of the first adjustable member 261*a*, and (d) is a perspective view of the second adjustable member 262*b*.

In an example, the attachment system 260 is moved to a collapsed position so that the attachment system 260 fits between adjacent rungs on the ladder. The arms 261*a-b* may then be extended relative to arms 262*a-b* to fit securely between the adjacent ladder rungs, thereby securing the ladder safety apparatus to any desired position on the ladder. Once extended, arms 261*a-b* and 262*a-b* may be secured in any suitable manner, e.g., using the pin and hole locking mechanism described above, or other suitable locking mechanism.

An example locking mechanism is shown for purposes of illustration in FIGS. 8*a-d*, comprising a pin 201 (such as a screw or rivet) slidably engaging slot 202. The pin-in-slot configuration enables the arms 261*a* and 261*b* to slide relative to one another within a confined travel area defined by the slot 202 and the side rails 203 and 204 of the arms 261*a* and 262*a*, respectively. A stopper 205 (e.g., a screw or rivet) prevents travel beyond a predetermined distance.

A snap button 206 (e.g., a spring-biased pin) may also be provided to lock the arms 261*a* and 262*b* at a predetermined position between the rungs of the ladder. The snap button 206 may be depressed (e.g., the user may depress the button using his or her thumb or finger) to slide arm 262*a* over the snap button 206 and over arm 261*a* in the direction of arrow 207*a*, thus collapsing the attachment system 260 (FIG. 8*a*).

The user can then position the attachment system between adjacent ladder rungs and spread the attachment system 260 apart by pulling arm 262*a* in the direction of arrow 207*b* relative to arm 261*a*. When arm 262*a* passes over and clears snap button 206, the snap button 206 automatically deploys under action by the spring bias and maintains arms 261*a* and 262*a* in a spread-apart configuration (FIG. 8*b*) between the ladder rungs so that the attachment system 206 does not collapse during use.

Multiple pins and stop rivets may be provided so that the attachment system 260 provides a substantially universal fit, e.g., for different size ladders having different rung spacing.

Figure 9A:
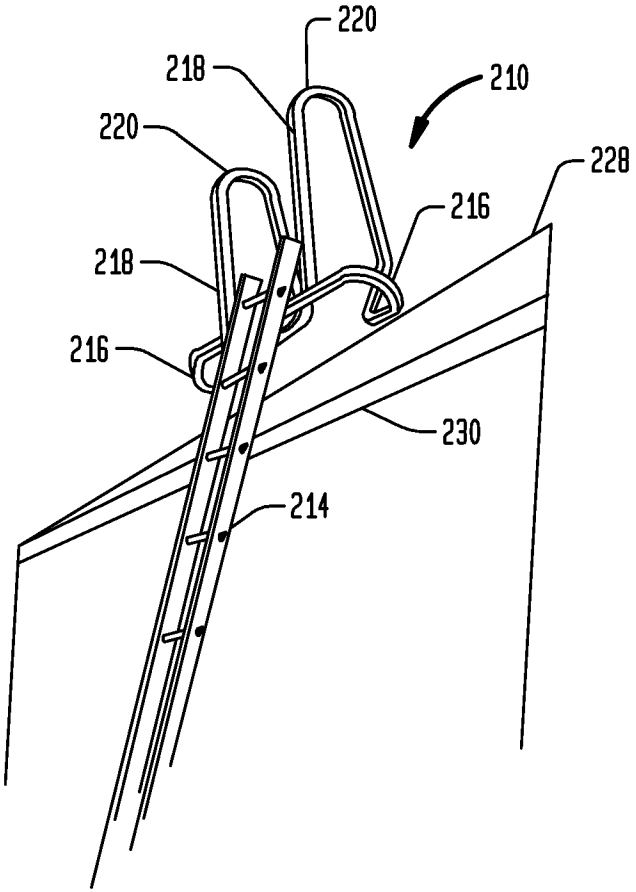
FIG. 9*a* is an illustration showing the example ladder safety apparatus of FIG. 7 as it may be used on a roof top.
Figure 9B:
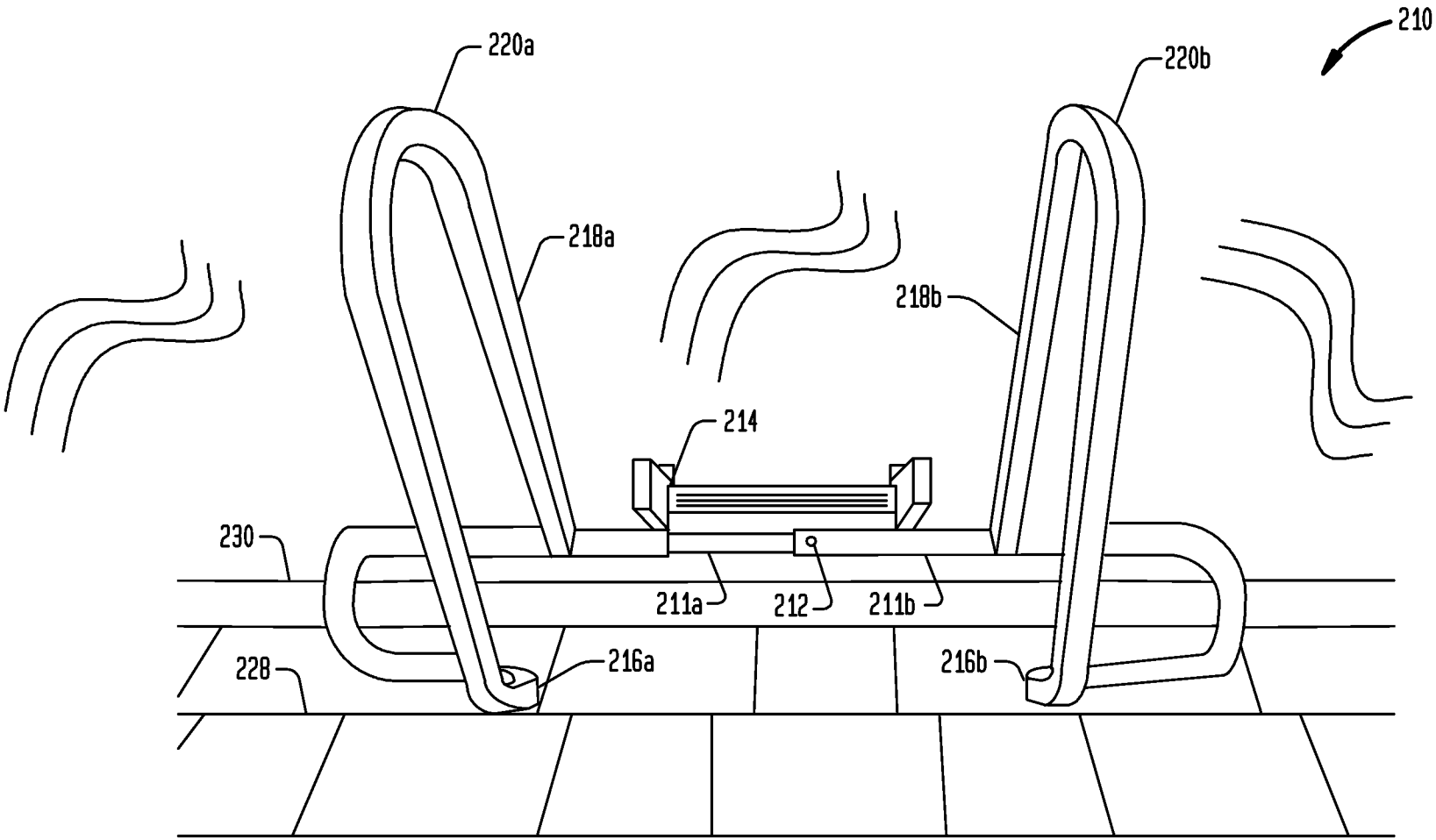
FIG. 9*b* is another illustration showing the example ladder safety apparatus of FIG. 7 as it may be used on a roof top.

FIG. 9*a* is an illustration showing the example ladder safety apparatus 210 of FIG. 7 as it may be positioned over a roof top 228 for use thereon. It is shown that the ladder 214 readily clears gutter 230. FIG. 9*b* is another illustration showing the example ladder safety apparatus 210 of FIG. 7 after it has been positioned on the roof top 228 such that the stabilizer bar 216 makes contact with the roof top 228 and supports the ladder both laterally and vertically. Balance rails 218 and handles 220 provide a substantially vertical support for the user to grasp as the user climbs up the top of the ladder 214 and onto the roof top 228.

An adjustable width of the ladder safety apparatus 210 can also be seen in FIG. 9*a*. The adjustable width is made possible in this example by providing a smaller tube member 211*a* on one side of stabilizer bar 216*a* which fits into and slides relative to a larger tube member 211*b* on the other side of stabilizer bar 216*b*. A pin 212 may be provided in a hole to maintain the desired width of the stabilizer bar with side 216*a* held in a fixed relation relative to side 216*b*.

Figure 10A:
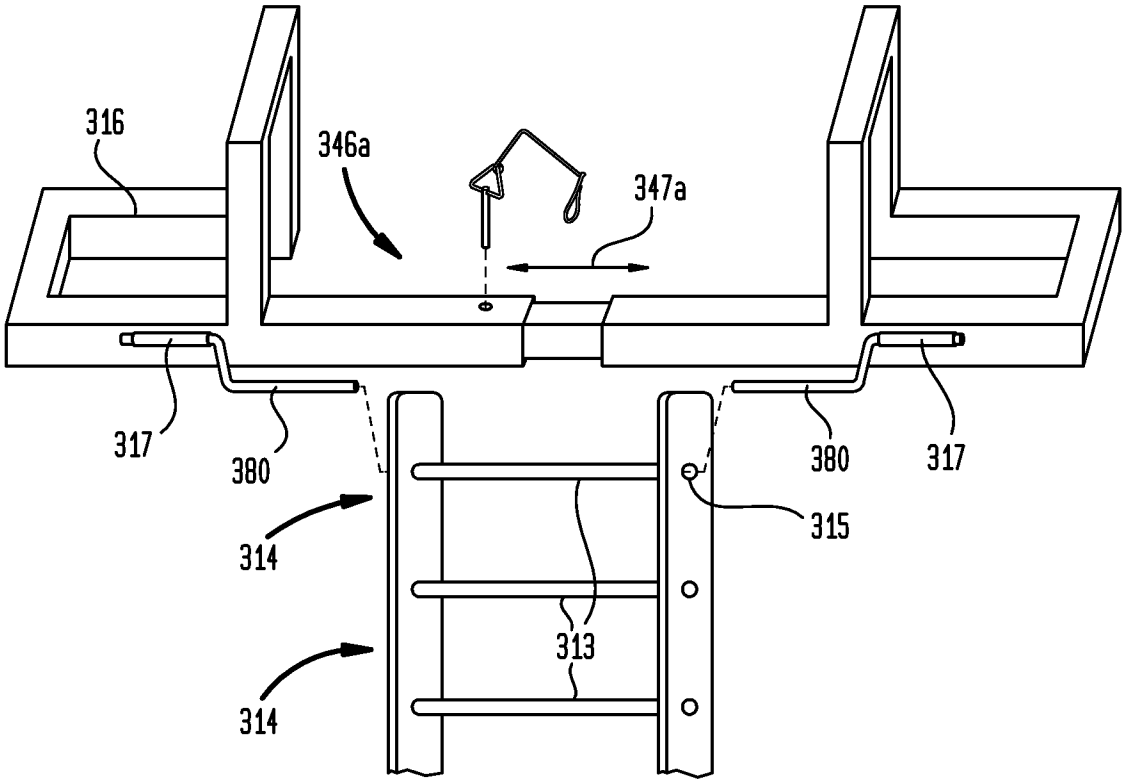
FIG. 10*a* is a perspective view of another example ladder safety apparatus positioned to engage a ladder rung.
Figure 10B:
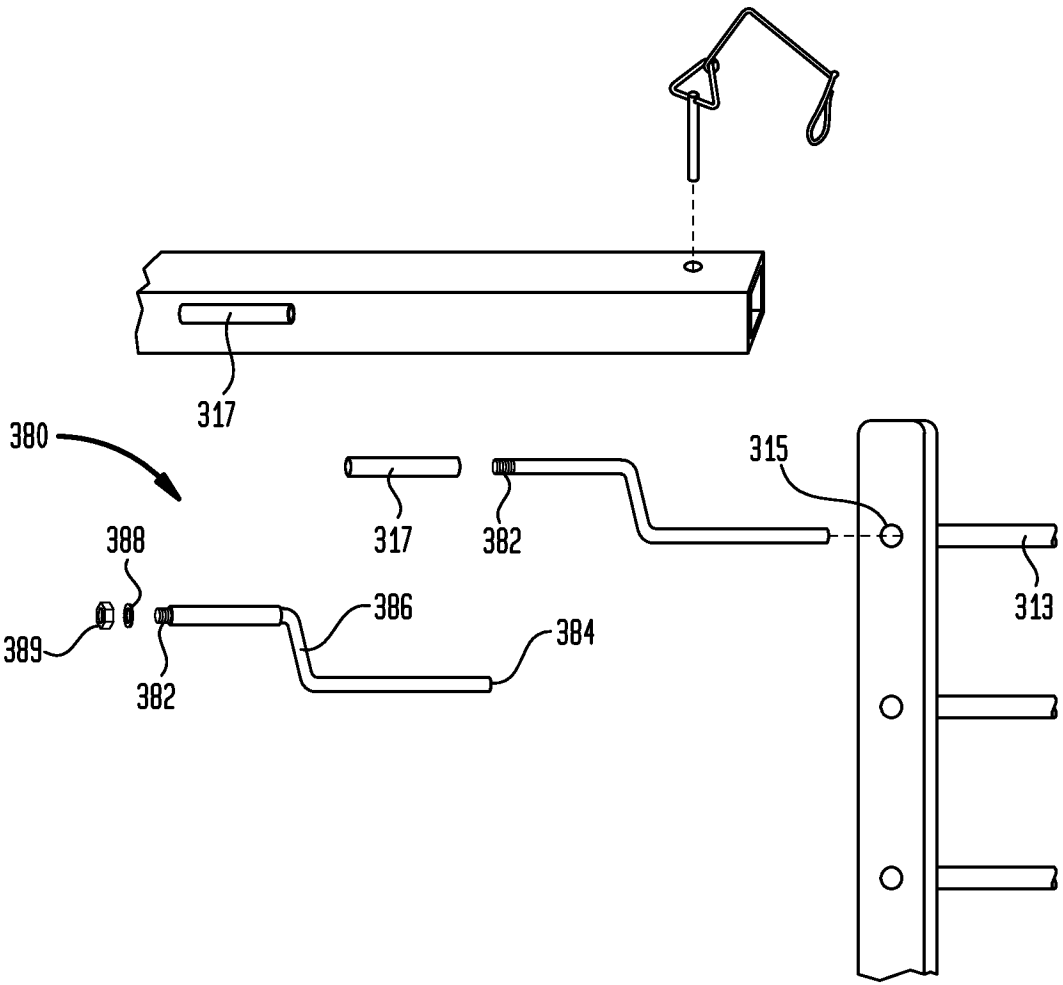
FIG. 10*b* is an exploded detail view of the example ladder safety apparatus of FIG. 10*a*.
Figure 10C:
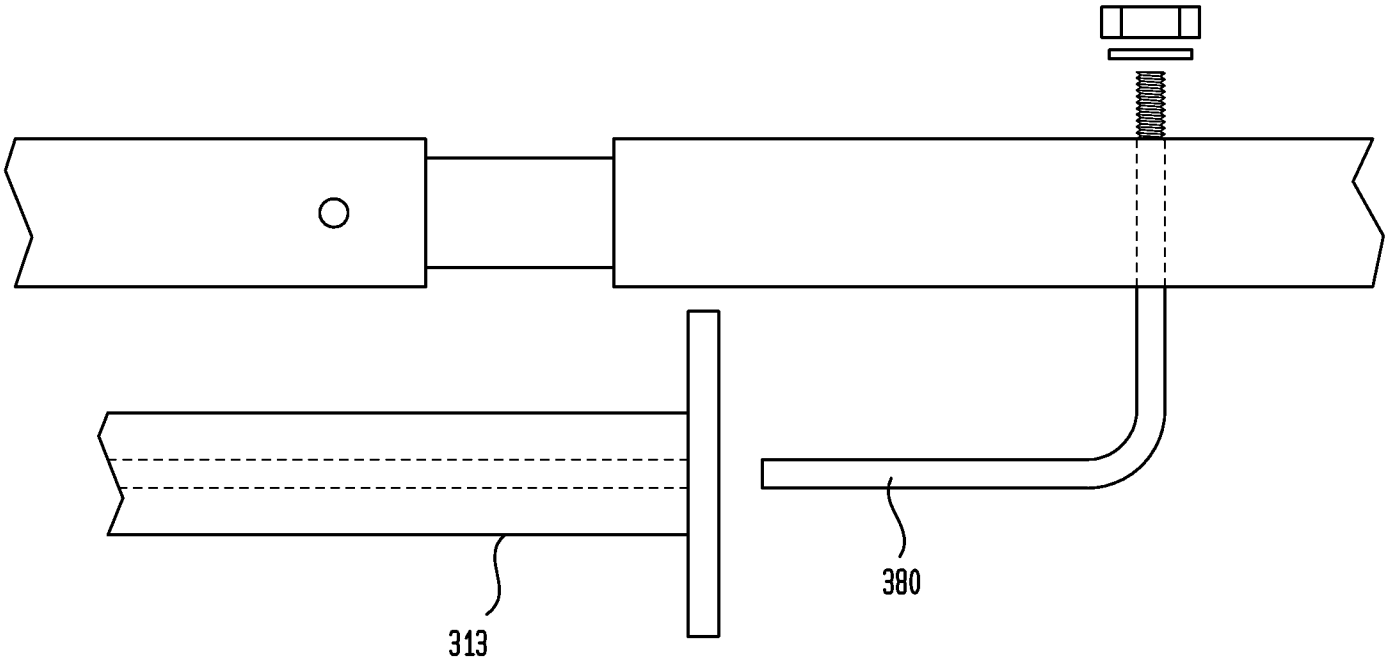
FIG. 10*c* is an exploded detail view of another example ladder safety apparatus that can be used instead of the example shown in FIG. 10*a*.

Another example embodiment of ladder safety apparatus is shown in FIGS. 10*a-c*. It is noted that the ladder safety apparatus is illustrated in this example having sharper edges or more square-shaped components, such as may be the case when the apparatus is made without bending the components. However, either the rounded or square versions may be implemented in any of the examples without departing from the scope of the disclosure herein. It is also noted that entire assembly is not shown in FIGS. 10*b-c* for purposes of simplifying the drawing. Broken lines are used to indicate that the ladder safety apparatus shown in FIGS. 10*b-c* includes the entire assembly shown in FIG. 10*a*.

Two engaging rods 380 are configured to engage an internal lumen 315 of at least one rung 313 of the ladder from opposite ends. Distal ends of the engaging rods 380 may be coupled with the stabilizer bar by sleeves 317. In some embodiments, engaging rods 380 are capable of rotation within sleeves 317 and may be held thereto by threading a nut 389 and washer 388 onto threaded distal end 382 of each engagement rod 380. It should be noted that hardware other than nuts 389 and washers 388 may be used to prevent rods 380 from sliding out of sleeves 317 in a proximal or medial direction towards one another.

An example configuration of engaging rods 380 may be with proximal 384 and distal 382 ends which are spaced apart by arm 386 so as to be non-collinear. It should be noted that proximal 384 and distal 382 ends may be coplanar while being non-collinear. In this configuration, engagement rods 380 may be prevented from excessive travel in a distal or lateral direction away from one another by engagement of arm 386 with proximal ends of sleeves 317.

Stabilizer bar 316 is adjustable in the direction of arrow 347*a* between a shortened length and an extended length. Adjustment towards a shortened length also moves engaging rods 380 towards a proximal or medial direction to enable penetration of engaging rods 380 into the rung internal lumen 315. Adjustment towards an extended length moves engaging rods 380 towards a distal or lateral direction to enable positioning of engaging rods 380 completely external to the rung internal lumen 315.

A stopper 346*a* is configured to limit adjustment of stabilizer bar 316. In some embodiments, the stopper may be provided as a pin and through hole but the stopper is not limited to this means.

FIG. 10*c* is an exploded detail view of another example engaging rod 380 that can be used with the ladder safety apparatus, instead of the example shown in FIG. 10*a*. In this example, the engaging rod 380 may also be mounted through the ladder rung 313 similar to that shown and described in FIG. 10*a*, but instead of being mounted through sleeves 317, it bolted to the ladder safety apparatus.

Figure 11A:
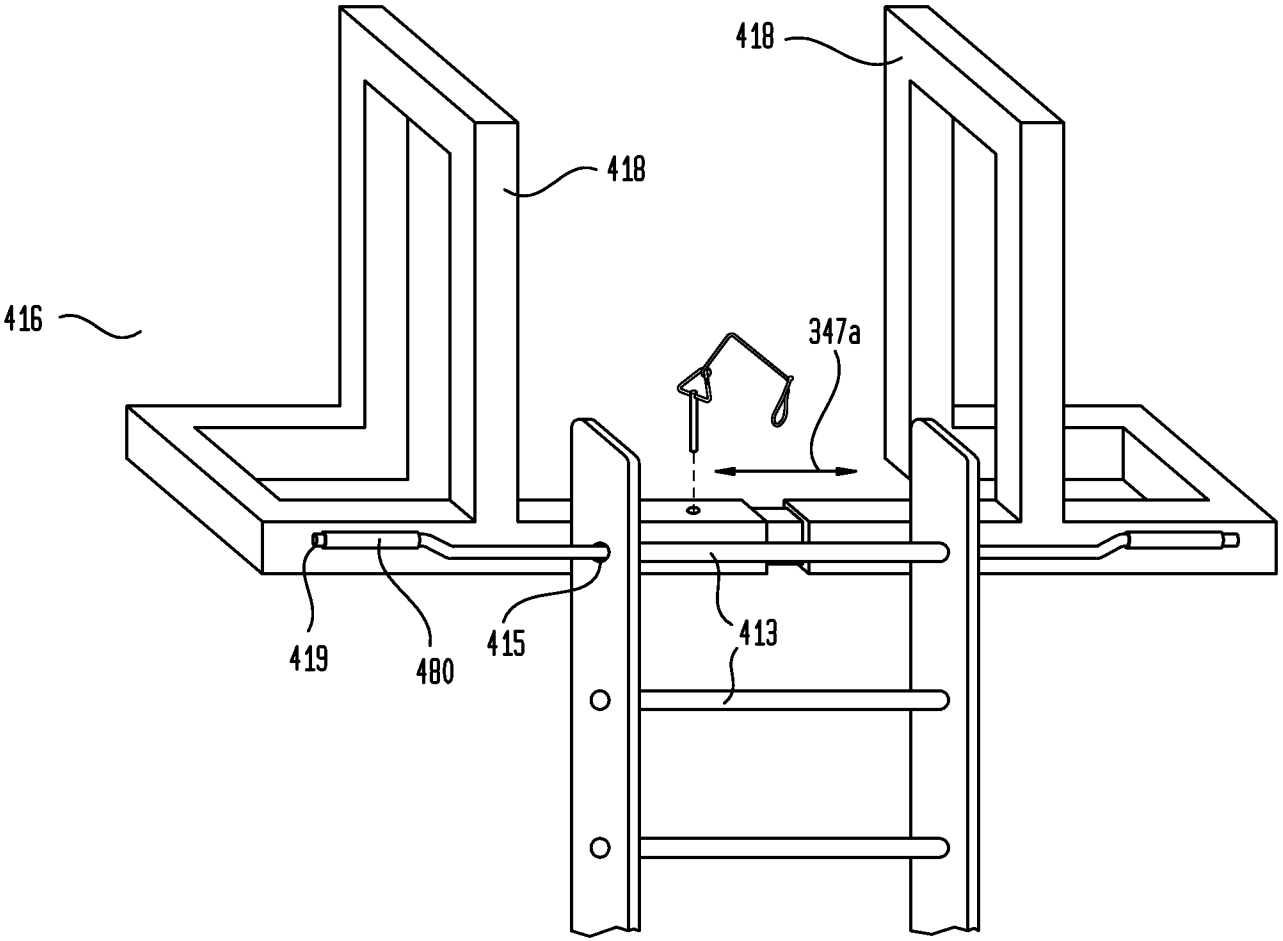
FIG. 11*a* is a perspective view of another example ladder safety apparatus engaged with a ladder rung.
Figure 11C:
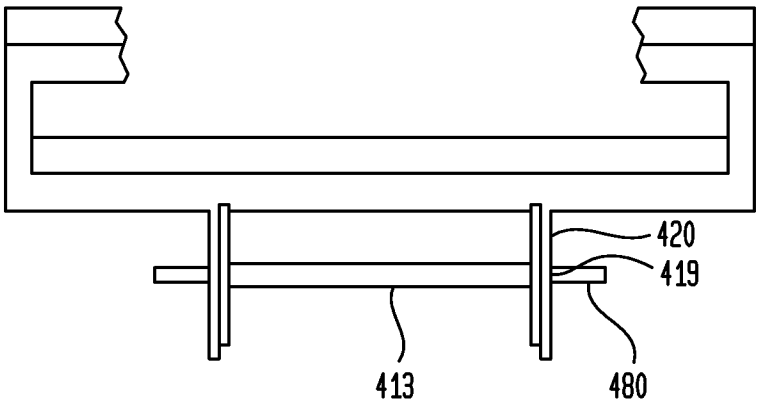
FIG. 11*c* is a top view of the example ladder safety apparatus of FIGS. 11*a*-11*b* engage with a ladder rung.
Figure 11B:
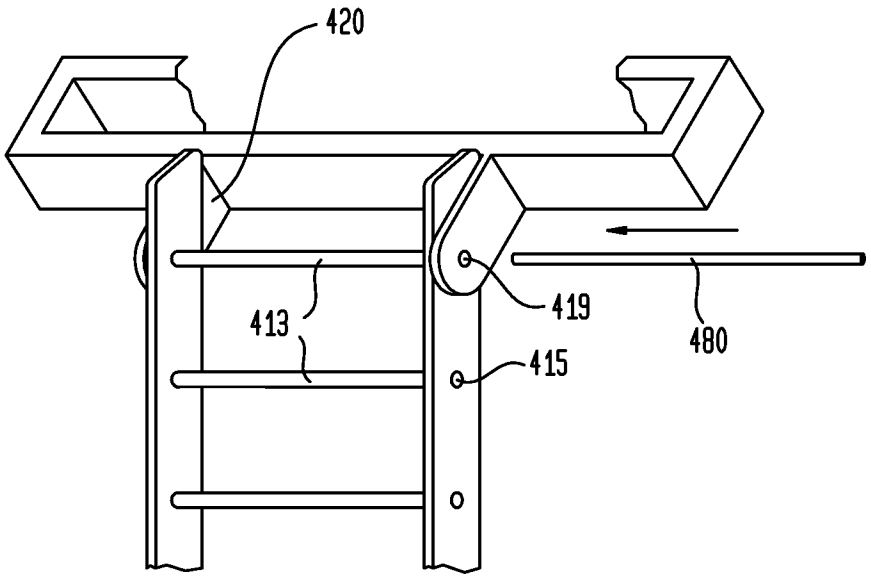
FIG. 11*b* is an exploded view of the example ladder safety apparatus of FIG. 11*a* positioned to engage a ladder rung.

Yet another example of a ladder safety apparatus is shown in FIGS. 11*a-c*. It is noted that the entire assembly is not shown in FIGS. 11*b-c* for purposes of simplifying the drawing. Broken lines are used to indicate that the ladder safety apparatus shown in FIGS. 11*b-c* includes the entire assembly (e.g., the balance rails 418) shown in FIG. 11*a*. One engaging rod 480 is coupled to a stabilizer bar 416 by at least one eyelet 419 such that the engaging rod may be slid within eyelet 419 between a position at least partially within rung internal lumen 415 and a position completely external to rung internal lumen 415. This embodiment may also be provided with balance rails 418.

In some embodiments, two eyelets 419 and 420 are provided in a configuration enabling simultaneous, spaced apart engagement of engaging rod 480. For example, eyelets 419 and 420 are provided on stabilizer bar 416 at a spacing large enough to accommodate the width of most common ladders. In some embodiments, stabilizer bar 416 may be configured for adjustment between shortened and extended positions such that the distance between eyelets 419 and 420 may be changed to accommodate a larger variety of ladder widths.

Before continuing, it should be noted that the examples described above are provided for purposes of illustration, and are not intended to be limiting. Other devices and/or device configurations will also be readily apparent to those having ordinary skill in the art after becoming familiar with the teachings herein.

A method of using the ladder safety apparatus discussed above may include adjusting a stabilizer bar on a ladder to rest the stabilizer bar on a roof top without the stabilizer bar and the ladder touching a gutter and fascia. The method may also include adjusting a balance rail for the top portion of the ladder to provide handles for a user climbing up the ladder to the roof top. The method may also include providing a strap to connect the ladder safety apparatus adjacent the roof top for securing the ladder.

The operations shown and described herein are provided to illustrate example implementations. It is noted that the operations are not limited to any particular ordering. Still other operations may also be implemented with the apparatus disclosed herein.

By way of illustration, further operations may include rotating the stabilizer bar relative to the ladder safety apparatus, extending legs from the stabilizer bar, and/or extending legs from the balance rail to adjust a height of the handles. In addition, a width of the stabilizer bar may be changed, wherein a width of the balance rail changes with changing width of the stabilizer bar.

With reference to FIGS. 10*a-b*, an example method of coupling a ladder safety apparatus to a ladder is now described. First and second engaging rods 380 are provided to a stabilizer bar 316. It is noted that in other examples, the engaging rod 380 may be configured as a single piece (instead of first and second rods). Stabilizer bar 316 is extended to increase a distance between proximal ends 384 of the first and second engagement rods 380 and proximal ends 384 are positioned near an internal lumen 315 of a ladder rung 313. With proximal ends 384 in position, stabilizer bar 316 may be shortened to cause proximal ends 384 to penetrate internal lumen 315 and thereby grip the ladder.

With reference to FIGS. 11*a-c*, another example method of coupling a ladder safety apparatus to a ladder is now described. An internal lumen 415 of a ladder rung 413 is engaged with a single engaging rod 480 by inserting engaging rod 480 through a first eyelet 419 of stabilizer bar 416, through rung internal lumen 415 and then through a second eyelet 420 of stabilizer bar 416. Ends of engaging rod 419 may then be secured to prevent movement along the longitudinal axis of engaging rod 419. This may be accomplished, for example, using hardware including but not limited to nuts and washers.

Methods of coupling a ladder safety apparatus to a ladder may be performed in combination with other steps of using a ladder safety apparatus. For example, in some embodiments, a ladder safety apparatus may be coupled to a ladder and then the ladder may be positioned to rest the stabilizer bar on a roof top without the stabilizer bar or the ladder touching a gutter or fascia. In other embodiments, the ladder may be positioned to rest the stabilizer bar on a roof top without the stabilizer bar or the ladder touching a gutter or fascia and the safety apparatus may subsequently be coupled to the ladder. As with other method embodiments, in either of these examples an adjustable balance rail may also be provided for the top portion of the ladder to offer handles for a user climbing up the ladder to the roof top as described above.

It is noted that the examples shown and described are provided for purposes of illustration and are not intended to be limiting. Still other examples are also contemplated.

The invention claimed is:

1. A ladder safety system comprising:

a stabilizer bar for a top portion of a ladder, the stabilizer bar configured to rest on a roof top;

a balance rail for the top portion of the ladder to provide substantially upright handles for a user to grasp when the ladder is positioned on the roof top; and at least one engaging rod operatively coupled with the stabilizer bar to engage an internal lumen of at least one rung of the ladder; and a sleeve on the stabilizer bar concentrically holding the at least one engaging rod in a fixed lateral position relative to the stabilizer bar while allowing the at least one engaging rod to rotate within the sleeve, wherein the at least one engaging rod includes two engaging rods configured to engage the internal lumen from opposite ends, wherein the stabilizer bar is adjustable between a shortened length wherein the engaging rods may penetrate the rung internal lumen and an extended length wherein the engaging rods may be completely external to the rung internal lumen.

2. The apparatus of claim 1, further comprising a stopper configured to limit adjustment of the stabilizer bar.

3. The apparatus of claim 1, further comprising a pin and through hole configured to limit adjustment of the stabilizer bar.

4. The apparatus of claim 1, wherein the engaging rods include proximal and distal portions which are non-collinear.

5. The apparatus of claim 1, wherein the stabilizer bar further provides footings configured to engage a portion of the roof top.

6. The apparatus of claim 1, wherein the stabilizer bar and the balance rail maintain the ladder apart from the roof top, gutters, and fascia without touching the gutters and the fascia to prevent the ladder from scratching the gutters and fascia.

7. The apparatus of claim 1, further comprising an extension for the balance rail to adjust the handrail for contact with the roof top.

* * * * *